United States Patent [19]

Wochnowski

[11] 4,116,203

[45] Sep. 26, 1978

[54] METHOD AND APPARATUS FOR BLENDING TOBACCO

[75] Inventor: Waldemar Wochnowski, Hamburg-Meiendorf, Fed. Rep. of Germany

[73] Assignee: Hauni-Werke Körber & Co. KG., Fed. Rep. of Germany

[21] Appl. No.: 711,704

[22] Filed: Aug. 5, 1976

[30] Foreign Application Priority Data

Nov. 9, 1975 [DE] Fed. Rep. of Germany ..... 2540411

[51] Int. Cl.[2] ..... A24B 3/08; B01F 11/00; B01F 13/02

[52] U.S. Cl. ..... 131/138; 131/134; 131/140 B; 366/107; 366/109; 366/114

[58] Field of Search ..... 131/20 R, 21 R, 23 R, 131/108, 133 R, 134, 135, 136, 137, 138, 140 R, 140 B, 144, 146; 259/2

[56] References Cited

U.S. PATENT DOCUMENTS

| | | | |
|---|---|---|---|
| 3,590,826 | 7/1971 | Wochnowski et al. | 131/146 X |
| 4,004,594 | 1/1977 | Wochnowski et al. | 131/135 |

*Primary Examiner*—Robert W. Michell
*Assistant Examiner*—V. Millin
*Attorney, Agent, or Firm*—Peter K. Kontler

[57] ABSTRACT

Shredded tobacco is blended with expanded tobacco on the foraminous bottom wall of an elongated vibratory conveyor which receives overlapping streams of shredded and expanded tobacco at one end of the bottom wall in such quantities that the ratio of shredded tobacco to expanded tobacco remains constant. Blowers are provided to supply compressed hot and cool air against the underside of the bottom wall whereby streamlets of air pass through the perforations of the bottom wall and travel across the particles of tobacco in the vibratory conveyor to convert such particles into a fluidized bed of substantially constant height which advances toward the other end of the bottom wall. The speed of streamlets is reduced above the fluidized bed to prevent the ascending streamlets from entraining appreciable quantities of particles from the bed. The particles which form the fluidized bed are intimately mixed with each other before they leave the conveyor. A nozzle is provided to sprinkle atomized casing or top flavor onto the fluidized bed above the bottom wall.

24 Claims, 2 Drawing Figures

METHOD AND APPARATUS FOR BLENDING TOBACCO

BACKGROUND OF THE INVENTION

The present invention relates to a method and apparatus for blending two or more different types of fibrous material, especially for intimately mixing several types of tobacco. More particularly, the invention relates to a novel and improved method and apparatus for blending different types of tobacco preparatory to processing of the resulting mixture in machines for the production of rod-shaped or other smokers' products.

It is often necessary to mix natural tobacco (such as whole leaves, rag, shreds of tobacco leaf laminae, fragments of ribs or stem, or a mixture of these) with reconstituted tobacco and/or with so-called expanded or puffed tobacco. A mixture which contains different types of tobacco must be homogeneous throughout in order to avoid undesirable fluctuations in taste from article to article, e.g., from cigarette to cigarette. In accordance with the presently prevailing practice, mixing of different types of tobacco is normally performed in rotating drums or in so-called blending boxes. Such apparatus are capable of forming acceptable mixtures; however, they invariably subject the particles of tobacco to substantial mechanical stresses with the result that the mixture contains a high percentage of short tobacco and/or tobacco dust. Particles of tobacco dust contaminate the plant and are likely to adversely affect the operation of highly sensitive equipment, such as testing devices which monitor the condition of wrappers of cigarettes, cigars or cigarillos and/or the density of tobacco-containing ends of rod-shaped smokers' products. Furthermore, pronounced mechanical stressing of tobacco particles is highly undesirable when the mixture which is to be homogenized contains sensitive expanded or puffed tobacco which is normally admitted to tobacco shreds in order to contribute to compactness of cigarette fillers without appreciable increase in the weight. Mechanical stressing of expanded tobacco is likely to reduce the volume of puffed particles with the result that the filler of a cigarette must contain a larger quantity of tobacco, i.e., of the most expensive component of a smokers' product.

OBJECT AND SUMMARY OF THE INVENTION

An object of the invention is to provide a novel and improved method of blending different types of fibrous materials, especially tobacco, in a small area, without excessive mechanical stressing of fibrous material, and in such a way that different types of fibrous material are uniformly distributed throughout the resulting mixture.

Another object of the invention is to provide a method which is especially suited for mixing expanded or puffed tobacco with other tobacco types, such as shreds of tobacco leaf laminae.

A further object of the invention is to provide a method of the above-outlined type which, in addition to the making of a homogeneous mixture consisting of different types of tobacco, can be resorted to for simultaneous conditioning of tobacco with one or more similar or different fluid media.

An additional object of the invention is to provide a novel and improved apparatus for the practice of the above outlined method.

Another object of the invention is to provide an apparatus which can be readily adjusted to regulate the extent of homogenization of the mixture, which produces negligible quantities of short tobacco and/or tobacco dust, and which can contact each and every particle of the mixture with one or more gaseous and/or liquid fluids.

An ancillary object of the invention is to provide a tobacco blending apparatus which can be used for simultaneous drying, cooling, flavoring and/or moistening of tobacco.

One feature of the invention resides in the provision of a method of blending fibrous materials, particularly tobacco. The method comprises the steps of admitting at least two different types of fibrous material into a mixing or blending zone (preferably onto the foraminous bottom wall of an elongated vibratory conveyor), vibrating the material in the mixing zone, conveying ascending streamlets of a fluid medium (preferably hot and/or cool air or another suitable gas) at a predetermined speed across the material in the mixing zone to convert such material into a fluidized bed of substantially constant height wherein different types of material are intimately mixed with each other to form a homogeneous blend, and gradually reducing the speed of the fluid medium immediately above the fluidized bed to a second speed at which the ascending medium is incapable of entraining appreciable quantities of fibrous material from the mixing zone.

The method preferably further comprises the step of maintaining the ratio of quantities of different types of fibrous material in the mixing zone within a predetermined range. This can be achieved by admitting metered quantities of each fibrous material, and such metered quantities may be admitted in the form of continuous streams. One of the streams can be admitted on top of the other stream; the blending takes place as a direct result of formation of the fluidized bed because the particles are caused to rise and fall in the course of the vibrating step as well as under the action of ascending streamlets of fluid medium or media.

In accordance with a presently preferred embodiment of the method, fibrous material which is admitted into the mixing zone is moved in a predetermined direction, and the conveying step comprises conveying ascending streamlets of a hot gas across a first portion of the mixing zone and conveying ascending streamlets of a gaseous coolant across a second portion of the mixing zone. The contact between hot gas and the particles which form the fluidized bed can take place upstream or downstream of the region of contact between fibrous particles and gaseous coolant.

It is often desirable to intimately contact the particles of the fluidized bed with a liquid, such as casing or another flavoring agent for tobacco, e.g., so-called top flavor. This can be achieved by sprinkling dispersed (atomized) liquid onto the particles in the mixing zone. The liquid can be sprinkled by resorting to one or more spray nozzles which discharge atomized liquid onto successive increments of the fluidized bed; such bed moves in a predetermined direction, preferably as a result of vibration of the aforementioned bottom wall.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
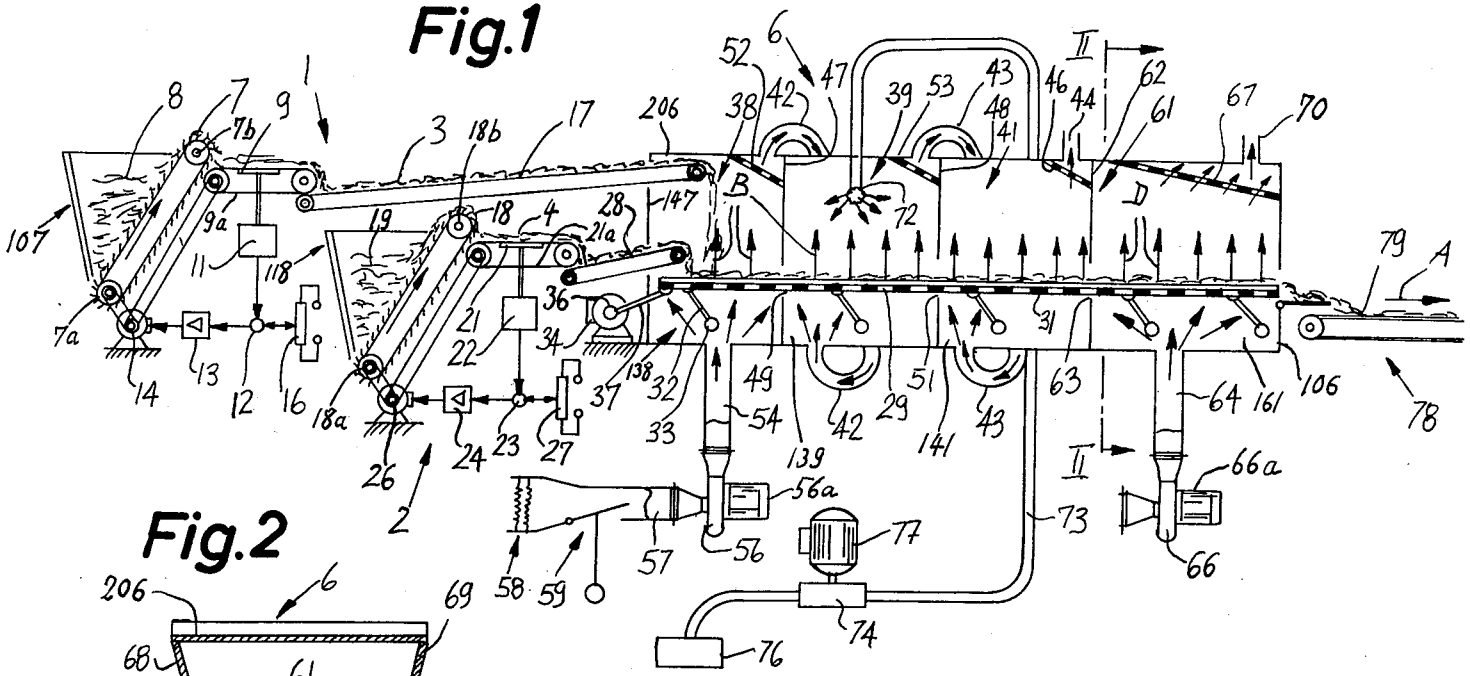
FIG. 1 is a schematic partly side elevational and partly longitudinal vertical sectional view of an apparatus which embodies the invention.

The apparatus of FIG. 1 comprises a blending or mixing conveyor 6 including an elongated substantially horizontal foraminous bottom wall or support 31 and two side walls 68, 69 (shown in FIG. 2) which diverge at a constant rate away from each other in a direction upwardly and away from the support 31. The perforations of the support 31 are shown at 29. The apparatus further comprises means for admitting two different types of tobacco onto the left-hand end of the support 31, and such admitting means includes two discrete conveyor units 1 and 2. The unit 2 feeds a continuous stream of tobacco 4 of a first type, and the unit 1 feeds a continuous stream of tobacco 3 of a second type.

The conveyor unit 1 comprises a magazine 107 containing a supply 8 of tobacco 3. The magazine 107 includes an endless carded belt conveyor 7 the left-hand reach of which travels upwardly, as viewed in FIG. 1, and draws from the supply 8 a continuous layer of tobacco 3. The belt conveyor 7 is trained over pulleys 7*a* and 7*b* and its upper end discharges tobacco onto an endless belt conveyor 9*a* forming part of a weighing device 9 which further includes a suitable transducer 11 serving to transmit electric signals to a signal comparing junction 12. The junction 12 further receives reference signals from an adjustable potentiometer 16 or another suitable source of reference signals, and its outlet transmits signals to an amplifier 13 which is in circuit with an infinitely variable-speed electric d-c motor 14 serving to drive the pulley 7*a* for the carded belt conveyor 7 and one of the pulleys for the belt conveyor 9*a*. The signals which are transmitted by the transducer 11 are indicative of the weight of tobacco 3 on the belt conveyor 9*a*; when the intensity of such signals deviates from the intensity of reference signals from the potentiometer 16, the amplifier 13 changes the speed of the motor 14 and conveyors 7 and 9*a* so that the conveyor 7 withdraws more tobacco when the intensity of the reference signals exceeds the intensity of signals from the transducer 11, and the conveyor 7 withdraws a smaller quantity of tobacco per unit of time when the intensity of signals from the transducer 11 exceeds the intensity of reference signals. The conveyor 9*a* of the weighing device 9 delivers tobacco 3 onto the upper reach of an intermediate conveyor 17, preferably an elongated belt conveyor, which receives motion from a separate prime mover, not shown, so that it can deliver a continuous stream of tobacco 3 into a chamber 38 above the left-hand end of the support 31 independently of the speed of carded belt conveyor 7.

The conveyor unit 2 is analogous to the conveyor unit 1. It comprises a magazine 118 for a supply 19 of tobacco 4, and the magazine 118 includes a carded belt conveyor 18 which is trained over pulleys 18*a*, 18*b* and receives torque from a variable-speed d-c motor 26. This motor further drives the belt conveyor 21*a* of a weighing device 21 having a transducer 22 which transmits signals to a junction 23. The junction 23 further receives reference signals from an adjustable potentiometer 27 and transmits signals to an amplifier 24 for the motor 26 when the intensity of reference signals is less than or exceeds the intensity of signals from the transducer 22. The belt conveyor 21*a* of the weighing device 21 discharges tobacco 4 onto the upper reach of an intermediate belt conveyor 28 which is driven independently of the conveyors 18, 21*a* and discharges a continuous stream of tobacco 4 directly onto the left-hand end of the support 31, i.e., the stream which is fed by the intermediate conveyor 47 overlaps or overlies the stream which is fed by the intermediate conveyor 28. It will be noted that the discharge end of the intermediate conveyor 17 is located downstream of the discharge end of the intermediate conveyor 28, as considered in the direction (arrow A) of transport of tobacco by the blending conveyor 6.

The support 31 of the conveyor 6 is mounted on leaf springs 32 which are secured to an elongated trough-shaped portion 106 of the conveyor 6 by means of pins 33. The portion 106 is located at a level below the support 31 and is stationary. The means for oscillating the support 31 includes an electric motor 34 whose output element drives a disk 36 having an eccentrically mounted pin (not specifically shown) which is articulately connected to one end of a connecting rod 37. The other end of the connecting rod 37 is articulately secured to the support 31 so that the latter vibrates whenever the motor 34 is on.

The aforementioned chamber 38 above the left-hand end of the support 31 forms part of an elongated mixing zone which is located above the support 31 and is flanked by the divergent side walls 68, 69 of the blending conveyor 6. Such mixing zone includes three additional chambers 39, 41, 61, and the chambers 38–39, 39–41 and 41–61 are respectively separated from each other by transversely extending upright partitions 47, 48 and 62. The partitions 47, 48, 62 extend into the trough-shaped lowermost portion 106 of the conveyor 6 and have openings 49, 51, 63 for the support 31 as well as for the mixture of tobaccos 3 and 4 on the support.

The apparatus further comprises means for conveying ascending streamlets or currents of a fluid medium through the perforations 29 of the support 31 and across the fibrous material in the first three chambers 38, 39 and 41. Such conveying means comprises a blower 56 which is driven by a motor 56*a* and discharges compressed hot air into a pipe 54 which communicates with the trough-shaped portion 106 in a region between the partition 47 and the left-hand end of the support 31. The directions in which the streamlets of hot air flow across tobacco particles on the support 31 are indicated by arrows B. The compartment 138 into which the pipe 54 discharges hot air serves for distribution of hot air along the entire underside of the support 31 in the region between the partition 47 and a further partition or end wall 147 at the left-hand end of the trough-shaped portion 106.

The blending conveyor 6 further comprises a top wall 206 which overlies the chambers 38, 39, 41 and 61 and is (but need not be) rigid with the divergent side walls 68, 69. A suitably bent pipe 42 connects the upper part of the chamber 38 with a second compartment 139 which is defined by the trough-shaped portion 106 and support 31 between the partitions 47, 48. A sieve or filter 52 immediately below the inlet of the pipe 42 intercepts particles of tobacco 3 and/or 4 which are entrained by streamlets (arrows B) flowing from the perforations 29, across the chamber 38 and into the pipe 42. The latter admits such air into the compartment 139 whence the air flows through the perforations 29 between the partitions 47, 48, across the tobacco particles 3 and 4 on the support 31, and into the chamber 39. A further pipe 43 connects the chamber 39 with a compartment 141 below the support 31. The compartment 141 extends between the partitions 48, 62 and allows streamlets of hot air to flow upwardly through the perforations 29 and into the chamber 41. A sieve or filter 53 in the chamber 39 intercepts particles of tobacco which tend to enter the inlet of the pipe 43. The upper end of the chamber 41 has an outlet 44 (located above a sieve or filter 46) which discharges spent air into the surrounding atmosphere.

The inlet of the blower 56 is connected to a suction pipe 57 which is provided with an adjustable valve 59 (e.g., a pivotable flap) and whose intake end contains an electric resistance heater 48 for inflowing atmospheric air. The flap 59 can be pivoted by hand or by means of a suitable motor in response to signals which are furnished by a device (not shown) for monitoring the temperature of hot air in the pipe 54. If the flap 59 is pivoted anticlockwise, as viewed in FIG. 1, the temperature of air in the pipe 54 decreases because the ratio of unheated air in the mixture of heated unheated air flowing into the inlet of the blower 56 decreases.

The compartment 161 below the chamber 61 of the blending conveyor 6 receives a fluid coolant (preferably unheated atmospheric air) from a blower 66 whose inlet communicates with the atmosphere, which is driven by a motor **66*a*, and whose outlet discharges compressed air into a pipe 64. This pipe communicates with the compartment 161. Streamlets of cool air (see the arrows D) flow through the perforations 29 of the support 31 below the chamber 61 and across the particles of tobacco on the support 31. Spent air passes through a sieve or filter 67 and is discharged into the atmosphere by way of an outlet 70**.

Figure 2:
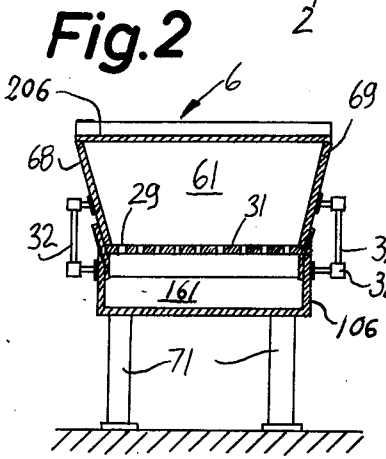
FIG. 2 is a transverse vertical sectional view as seen in the direction of arrows from the line II—II of FIG. 1.

The trough-shaped portion 106 of the conveyor 6 is mounted on several upright legs 71 (FIG. 1). The divergence of side walls 68, 69 is selected in such a way that the streamlets of hot air and/or cool air flowing upwardly and across tobacco particles on the support 31 in the chambers 38, 39, 41, 61 cannot entrain appreciable quantities of tobacco toward the respective sieves 52, 53, 46, 67. FIG. 2 further shows that the leaf springs 32 need not be directly coupled to the support 31, i.e., such leaf springs can be coupled to the side walls 68, 69 if the side walls share the vibratory movements of the support 31. The nature of these vibratory movements is such that the particles of tobacco 3 and 4 on the support 31 advance in the direction indicated by arrow A. The reference character 78 denotes a take-off conveyor which transports a homogenized mixture 79 of tobaccos 3 and 4 (blended tobacco) to storage or to a further processing station, e.g., directly into the magazine of a cigarette rod making machine, not shown.

FIG. 1 further shows means for intimately contacting tobacco particles in the chamber 39 with a dispersed liquid, e.g., with atomized casing or another flavoring agent for tobacco, such as top flavor. The contacting means includes a vessel 76 for a supply of liquid, a nozzle 72 which is installed in the chamber 39 and sprays atomized liquid onto the particles in the chamber 39, a supply conduit 73 which connects the vessel 76 with the nozzle 72, a metering device 74 (e.g., a suitable pump) in the conduit 73, and a prime mover 77 (e.g., a variable-speed electric d-c motor) for the metering device 74.

The operation:

The motors 14 and 26 are on so that the carded belt conveyors 7 and 18 draw continuous layers of tobacco from the respective supplies 8 and 19. The weighing devices 9 and 21 regulate the speed of the motors 14 and 26 so that the ratio of tobacco particles 3 which are delivered onto the upper reach of the intermediate conveyor 17 to tobacco particles 4 which are delivered onto the upper reach of the intermediate conveyor 28 is constant (such ratio depends on the setting of potentiometers 16 and 27). The magazine 107 can contain a supply of rather sensitive expanded or puffed tobacco, and the magazine 118 can contain a supply of tobacco shreds. The manner in which the particles of tobacco 3 are expanded is known and forms no part of this invention. Reference may be had to my U.S. Pat. No. 3,957,063 granted May 18, 1976. Successive increments of the tobacco stream which is discharged by the intermediate conveyor 28 descend onto the left-hand end of the vibrating support 31 and are overlapped by successive increments of the tobacco stream which is furnished by the intermediate conveyor 17. As mentioned above, the discharge end of the conveyor 17 is located downstream of the discharge end of the conveyor 28. It has been found that such mode of admitting the tobacco streams into the mixing zone enhances the homogenization of different tobacco types on the conveyor 6, especially on the left-hand end of the support 31.

The blower 56 supplies compressed hot air into the compartment 138 which supplies hot air to the perforations 29 below the chamber 38. Streamlets B of hot air pass through such perforations at a first speed, and their speed decreases gradually immediately above the layers of tobacco particles in the chamber 38 due to divergence of side walls 68 and 69, i.e., because the cross-sectional area of the mass of hot air increases in a direction upwardly and away from the support 31. The streamlets B cooperate with the vibrating support to convert the particles 3 and 4 in the chamber 38 into a fluidized bed of constant or nearly constant height. The vibrating support 31 and the streamlets B cause the particles to rise and fall whereby such particles undergo a pronounced homogenizing or blending action without subjecting the sensitive particles 3 to appreciable mechanical stresses. The support 31 causes the fluidized bed to advance in the direction indicated by arrow A so that successive increments of the bed enter into and pass through the second chamber 39 and thereupon through the third chamber 41. The fluidized bed remains intact because the pipe 42 conveys hot air from the chamber 38 into the compartment 139 whence the air flows through the perforations 29 of the support 31 and forms ascending streamlets B which enter into and rise in the chamber 39 prior to entering the pipe 43 which conveys them into the compartment 141. The latter admits hot air into the perforations 29 of the support 31 and the resulting streamlets 3 pass across the fluidized bed in the chamber 41 and are discharged via outlet 44. The streamlets B subject the particles of the fluidized bed to a more or less pronounced drying action. The extent of such drying action can be regulated by adjusting the position of the flap 59 in the suction pipe 57 for the blower 56. It is clear that each of the three compartments 138, 139, 141 can receive hot air or another heated gas from a discrete blower or that the apparatus may comprise two blowers for hot air one of which conveys air into two of the compartments 138, 139, 141 and the other of which admits air into the third compartment.

The motor 77 for the pump 74 is assumed to be on so that the pump 74 conveys a continuous stream of liquid from the vessel 76 to the nozzle 72 which sprays atomized liquid (e.g., casing) onto the particles of fluidized bed in the chamber 39. The apparatus may comprise one or more additional nozzles, or the nozzle 72 can be installed in the chamber 38 or 41. For example, the apparatus may comprise the nozzle 72 which sprays casing and a second nozzle (e.g., in the first chamber 38) which sprays top flavor onto the particles of tobacco in the chamber 38 or 41.

Successive increments of fluidized bed thereupon enter the fourth chamber 61 and are traversed by streamlets D of cool air which is conveyed by the pipe 64 and passes through the perforations 29 of the support 31 above the compartment 161. The temperature of air which flows through the pipe 64 is selected with a view to insure that the temperature of blended tobacco 79 which is fed onto the upper reach of the take-off conveyor 78 equals or approximates an optimum temperature for further processing. The vibrating support 31 cooperates with the streamlets D of cool air to effect a further intensive homogenization of particles which form the fluidized bed in the chamber 61.

The length of the support 31 depends on the desired extent of homogenization of the two tobacco types on the conveyor 6. The number of chambers can be reduced to three, two or one, or increased to five or more. Also, the blower 66 for cool air can be omitted or deactivated if the temperature of air flowing from pipe 43 into the compartment 141 is sufficiently low to insure that the temperature of blended tobacco 79 on the conveyor 78 does not exceed a predetermined maximum permissible value. An important advantage of the improved method and apparatus is that two or more types of tobacco or other fibrous material can be blended without subjecting the particles to excessive mechanical stresses which, in the case of tobacco particles, could result in the generation of excessive quantities of short tobacco and/or tobacco dust, or would unduly reduce the volume of expanded tobacco.

Another important advantage of the improved method and apparatus is that the blending operation can be regulated with a high degree of accuracy and reproducibility, as well as that the particles which form the fluidized bed can be subjected to one or more conditioning treatments including heating, cooling, heating and cooling (in a desired sequence), contacting with casing, top flavor and/or another flavoring agent. Such conditioning renders it possible to transport blended tobacco directly to the locale of use, e.g., into the magazine of a cigarette rod making machine, without any secondary treatment between the improved apparatus and the magazine. This, in turn, reduces the space requirements of machinery in a tobacco processing plant.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. A method of blending fiborus materials, particularly tobacco, comprising the steps of admitting at least two different types of fibrous material into a mixing zone wherein each of said different types have differing densities; vibrating the material in said zone; conveying ascending streamlets of a fluid medium at a predetermined speed across the material in said zone to convert such material into a fluidized bed of substantially constant height wherein the constituents of said different types of fibrous material rise and fall as a result of vibration as well as under the action of said streamlets whereby said different types of material are intimately mixed with each other; and reducing the speed of said fluid medium above said fluidized bed to a second speed at which the ascending medium is incapable of entraining appreciable quantities of fibrous material from said zone.

2. A method as defined in claim 1, further comprising the step of maintaining the ratio of quantities of said different types of fibrous material in said mixing zone within a predetermined range.

3. A method as defined in claim 1, wherein said fluid medium is a gas.

4. A method as defined in claim 1, wherein said admitting step includes feeding a first stream of fibrous material of one type into said mixing zone and feeding a second stream of fibrous material of another type on top of said first stream.

5. A method as defined in claim 1, wherein said fluid medium is a hot gas.

6. A method as defined in claim 1, wherein said fluid medium is a gaseous coolant.

7. A method as defined in claim 1, further comprising the step of moving the fibrous material in said mixing zone in a predetermined direction and said conveying step comprises conveying ascending streamlets of a hot gas across a first portion of said zone and conveying ascending streamlets of a gaseous coolant across a second portion of said zone, one of said portions being located ahead of the other of said portions, as considered in said direction.

8. A method as defined in claim 1, further comprising the step of contacting the fibrous material in said mixing zone with particles of a dispersed liquid.

9. A method as defined in claim 8, wherein said liquid is casing.

10. A method as defined in claim 8, wherein said liquid is top flavor.

11. A method as defined in claim 1, further comprising the step of transporting the fibrous material in said mixing zone in a predetermined direction, said vibrating step forming part of said transporting step.

12. Apparatus for blending fibrous materials, particularly tobacco, comprising a conveyor including an elongated foraminous support and means for vibrating said support; means for admitting different types of fibrous material onto one end of said support whereby the vibrating support advances the material in a direction toward the other end thereof wherein said different types having differing densities; means for conveying ascending streamlets of a fluid medium at a predetermined speed through said foraminous support and across the material on said support so that the material is converted into a fluidized bed of substantially constant height wherein the constituents of said different types of fibrous material rise and fall as a result of vibration as well as under the action of said streamlets whereby said different types of material are intimately mixed with each other wherein a homogeneous mixture is formed of said different types; and means for reducing the speed of said fluid medium above the fluidized bed to a second speed at which the ascending medium is incapable of entraining appreciable quantities of material from said bed.

13. Apparatus as defined in claim 12, wherein said admitting means includes means for feeding metered quantities of different types of fibrous material onto said first end of said support.

14. Apparatus as defined in claim 12, wherein said speed reducing means comprises two side walls flanking said support and diverging from each other in the direction of flow of said fluid medium above said fluidized bed.

15. Apparatus as defined in claim 12, wherein said conveying means comprises at least one source of compressed gaseous fluid.

16. Apparatus as defined in claim 12, wherein said admitting means includes a second conveyor arranged to feed a first stream of a first type of fibrous material directly onto said one end of said support and a third conveyor arranged to feed a second stream of a second type of fibrous material onto said first stream.

17. Apparatus as defined in claim 16, wherein said second and third conveyors respectively have first and second discharge ends and said second discharge end is located downstream of said first discharge end, as considered in said direction.

18. Apparatus as defined in claim 12, wherein said conveying means comprises at least one source of compressed hot gas.

19. Apparatus as defined in claim 12, wherein said conveying means comprises at least one source of compressed gaseous coolant.

20. Apparatus as defined in claim 12, wherein said conveying means comprises a source of compressed hot gas and a source of compressed gaseous coolant, one of said sources being located ahead of the other of said sources, as considered in said direction.

21. Apparatus as defined in claim 12, further comprising means for contacting the fibrous material of said fluidized bed with a dispersed liquid.

22. Apparatus as defined in claim 21, wherein said contacting means includes a source of liquid, an atomizing nozzle disposed above the fluidized bed on said support, and means for conveying liquid from said source to said nozzle.

23. Apparatus as defined in claim 21, wherein said liquid is casing.

24. Apparatus as defined in claim 21, wherein said liquid is top flavor.

* * * * *

UNITED STATES PATENT AND TRADEMARK OFFICE

CERTIFICATE OF CORRECTION

PATENT NO. : 4,116,203

DATED : September 26, 1978

INVENTOR(S) : Waldemar Wochnowski

It is certified that error appears in the above-identified patent and that said Letters Patent are hereby corrected as shown below:

Foremost page, left-hand column, Item [30], "Nov. 9, 1975" should read --Sept. 11, 1975--.
Col. 4, line 12, "47" should read --17--.
Col. 8, line 2, "fiborus" should read --fibrous--.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*